US005430264A

United States Patent [19]

Shinohara et al.

[11] Patent Number: 5,430,264

[45] Date of Patent: Jul. 4, 1995

[54] LIMIT SWITCH

[75] Inventors: Kenji Shinohara, Kyoto; Shigenobu Kishi, Osaka, both of Japan

[73] Assignee: Omron Corporation, Kyoto, Japan

[21] Appl. No.: 949,274

[22] Filed: Sep. 14, 1992

[30] Foreign Application Priority Data

| | | | |
|---|---|---|---|
| Sep. 14, 1991 | [JP] | Japan | 3-262696 |
| Sep. 14, 1991 | [JP] | Japan | 3-262697 |
| Sep. 14, 1991 | [JP] | Japan | 3-262699 |
| Sep. 14, 1991 | [JP] | Japan | 3-262700 |

[51] Int. Cl.[6] ..... H01H 3/16

[52] U.S. Cl. ..... 200/47; 200/329; 335/207

[58] Field of Search ..... 200/47, 564, 567, 565, 200/566, 329, 335, DIG. 36; 362/802; 74/335; 338/12, 103, 116; 335/207

[56] References Cited

U.S. PATENT DOCUMENTS

| | | | |
|---|---|---|---|
| 3,247,342 | 4/1966 | Ott et al. | 335/207 |
| 3,364,318 | 1/1968 | Bulliet | 200/302.1 |
| 3,524,111 | 8/1970 | Maecker et al. | 317/155.5 |
| 4,065,669 | 12/1977 | Bogel | 250/229 |
| 4,214,133 | 7/1980 | Wolford et al. | 200/302.1 |
| 4,762,972 | 8/1988 | Roeser | 200/302.1 |

FOREIGN PATENT DOCUMENTS

| | | |
|---|---|---|
| 0221513 | 5/1987 | European Pat. Off. . |
| 0390084 | 3/1990 | European Pat. Off. . |
| 1492199 | 7/1966 | France . |
| 1939205 | 8/1969 | Germany . |
| 2516905 | 11/1975 | Germany . |
| 470747 | 6/1978 | Switzerland . |

OTHER PUBLICATIONS

European Patent Office communication dated Oct. 28, 1994.

*Primary Examiner*—Henry J. Recla
*Assistant Examiner*—David J. Walczak
*Attorney, Agent, or Firm*—Fish & Richardson

[57] ABSTRACT

In a limit switch, its rotational operation section B includes a rotary shaft 9 which is rotatably supported on a head housing 5, and an actuator 10 for turning the rotary shaft 9, and its switch section C comprises a detector 29 which is built in a switch housing 3, to detect particular detection parts 27*a* and 27*b* in a non-contact mode which are provided on the outer cylindrical surface of a cam 25 mounted fixedly on the rotary shaft 9, thereby to provide a detection signal. The head housing 5 and the switch housing 3 are formed as one unit. A limit switch which is simple in construction, has a small number of components in comparison with the conventional limit switch, can be miniaturized, has a long service life, and is reliable in operation, is provided.

12 Claims, 21 Drawing Sheets

13
12
10
B
11
8
9
25c
25
25a
5
25b
9b
25d
26
3b
27a(27b)
29
55
C
3
28
A
34
38
30
3c
31
36
37

12
10
25
B
5
25d
46
C
48
47
50
49
28a
28
29
34
A
3
30
31
37

LIMIT SWITCH

BACKGROUND OF THE INVENTION

This invention relates to a limit switch which is used in a variety of manufacturing devices or industrial robots. A conventional limit switch of this type is shown in FIG. 24.

In FIG. 24, reference numeral 1 designates a housing which is made up of a switch housing body 3 incorporating a switch 2, and a cover 4 closing the side opening 3*a* of the switch housing body 3. A head housing 5 is detachably engaged with the upper end opening 3*b* of the switch housing body 3 with a plurality of bolts (not shown).

The head housing 5 has a shaft hole 6, in which a rotary shaft 9 is rotatably fitted with a collar 7 and an O-ring 8 so that one end portion 9*a* of the rotary shaft 9 extends outside the head housing 5. An actuator 10 is mounted on the one end portion 9*a* of the rotary shaft 9 and fixed with a screw 11. The actuator 10 includes a shaft; member 13, on which a roller 12 is mounted.

The axis of the rotary shaft 9 is perpendicular to the axis of the operating rod 22 of the switch 2. A flat cam 9*c* is formed on the other end portion 9*b* of the rotary shaft 9 so that it is located on the axis of the operating rod 22.

A bottomed-cylinder-shaped spring receiver 14 is placed on the cam 9*c*. A return spring 15, which is a coiled spring, is set between the spring receiver 14 and the inner surface of the head housing 5, thus providing a rotational return force to the rotary shaft 9.

On the other hand, an operating plunger 16 is interposed between the cam 9*c* and the operating rod 22 of the switch 2. The operating plunger 16 comprises a cylindrical plunger body 17, an auxiliary plunger 18 built in the plunger body 17, and a buffer spring 19 interposed between the plunger body and the auxiliary plunger. The operating plunger 16 is axially movably inserted into the upper end opening 3*b* of the switch housing body 3. A depressing pin 20 for depressing the operating rod 22 is secured to the end of the auxiliary plunger 18.

The switch housing body 3 has a lower end opening 3*c*, which is closed with a connector (not shown) to which electrical cables are connected.

The limit switch thus constructed operates as follows: When an object such as a workpiece under test abuts against the roller 12, the actuator 10 is turned about the rotary shaft 9 against the elastic force of the return spring. As the actuator 10 is turned in this way, the cam 9*c* is turned to push the operating plunger, so that the switch 2 is operated.

When the cam 9*c* is turned in the above-described manner, the spring receiver 14 is displaced to compress the return spring 15. When released, the actuator is returned to the original position by the elastic force of the return spring 15 thus compressed.

In order to operate the switch 2, it is necessary to convert the rotational motion of the actuator 10 into the linear motion of the operating plunger 16. Therefore, the motion converting mechanism is intricate, and accordingly it needs a relatively large number of components, with a result that the limit switch is unavoidably bulky. Furthermore, the limit switch has a relatively short service life because it has a number of sliding parts and suffers from an unreasonable amount of stress.

On the other hand, it is essential to hermetically seal the internal chamber of the switch housing body 3 to protect the switch 2 from damage. To achieve this goal, it is necessary to set a cylindrical plastic seal member 21 in the upper end opening 3*b* to make the internal chamber 1*a* airtight.

However, it is rather difficult to maintain an airtight internal chamber for the following reason: In order to permit the reciprocation of the operating plunger 10, it is necessary for the internal chamber 1*a* a of the switch housing 1 to change in volume and in pressure at all times; that is, it is necessary for the internal chamber 1*a* to breathe through the elastic seal member 21 to some extent. Thus, it is difficult to maintain an airtight internal chamber 1*a*. In addition, the breathing operation of the internal chamber 1*a* adversely affects the returning operation of the operating plunger, results in a delay in which is the switching operation of the switch 2.

SUMMARY OF THE INVENTION

Accordingly, an object of this invention is to eliminate the above-described difficulties that accompany a conventional limit switch. More specifically, an object of the invention is to provide a limit switch which, when compared with the conventional one, is simple in construction, has a small number of components, is small in size, has a long service life, and operates satisfactorily at all times.

The foregoing object of the invention has been achieved by a limit switch, according to the present invention, comprising a rotational operation section including a rotary shaft rotatably supported on a housing and an actuator for turning the rotary shaft, and a switch section provided below the rotational operation section wherein the rotational operation section is associated With the switch section without providing a plunger between the rotational operation section and the switch section.

In the limit switch according to the present invention, the rotational motion of the rotary shaft is directly detected by the detector to perform switch operation. The switch operation may be performed directly by the rotational motion of the rotary shaft. Therefore, it is unnecessary for the limit switch to employ a mechanism which converts the rotational motion of the actuator into a linear motion. Hence, the limit switch of the present invention, when compared with the conventional one, has fewer components, and therefore, can be miniaturized accordingly. In addition, the rotational operation section is not in contact with the switch section, and therefore the limit switch is free from unreasonable stress which increases its service life.

Furthermore, the housing of the limit switch is made up of the switch housing and the head housing which are formed as one unit. Therefore, a sealed structure can be readily formed without providing an elastic seal member between the two housings. In addition, the limit switch includes no mechanism for converting rotational motion into linear motion, which eliminates the difficulty that the space in the switch housing changes in volume and in pressure. Therefore, the unsatisfactory operation due to the unsteady returning operation of the actuator is eliminated; that is, the switching operation response is improved.

DETAILED DESCRIPTION OF THE PREFERRED EMBODIMENTS

Preferred embodiments of this invention will be described with reference to the accompanying drawings.

FIGS. 1 to 4 show an example of a limit switch, which constitutes a first embodiment of the invention.

Figure 1:
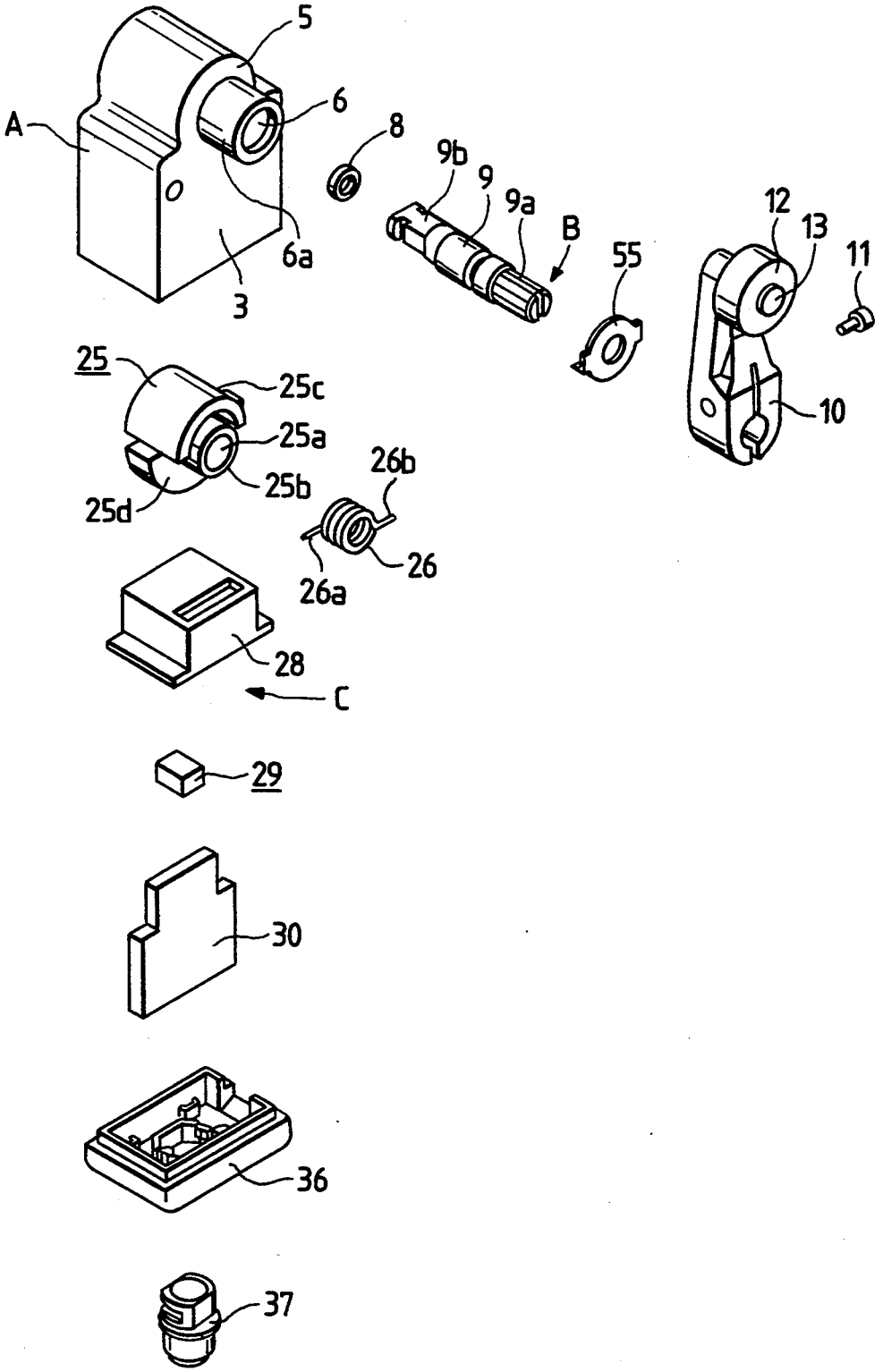
FIG. 1 is an exploded perspective view showing the arrangement of a first embodiment of this invention.
Figure 24:
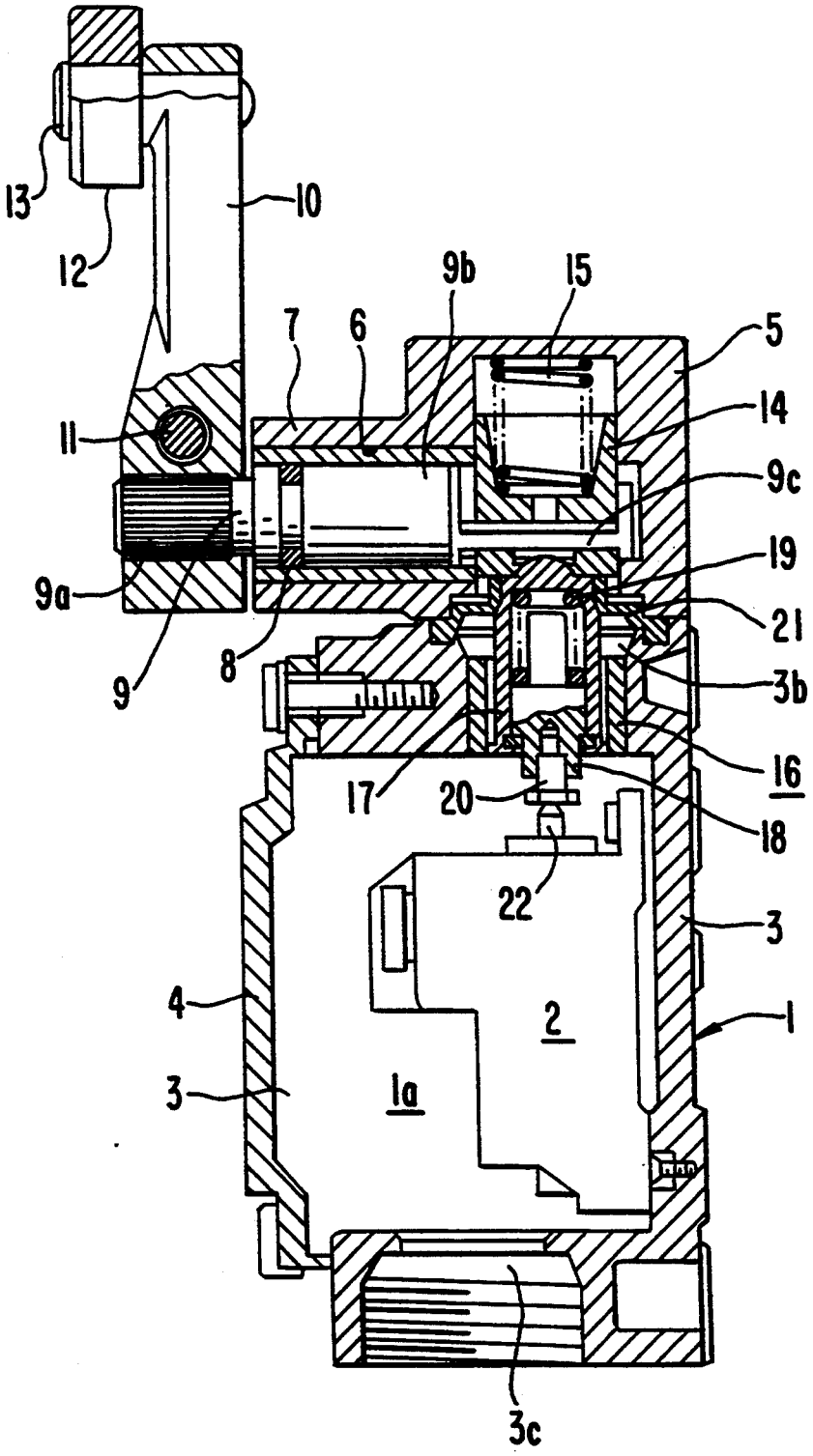
FIG. 24 is a side view showing essential components of a conventional limit switch.

In FIG. 1, parts equal to or corresponding functionally to those which have been described with reference to FIG. 24 are designated by the same reference numerals or characters.

As shown in FIG. 1, the limit switch comprises: a housing A; a rotational operation section B mounted, in the upper portion of the housing A; and a switch section C provided in the lower portion of the housing A.

Figure 2:
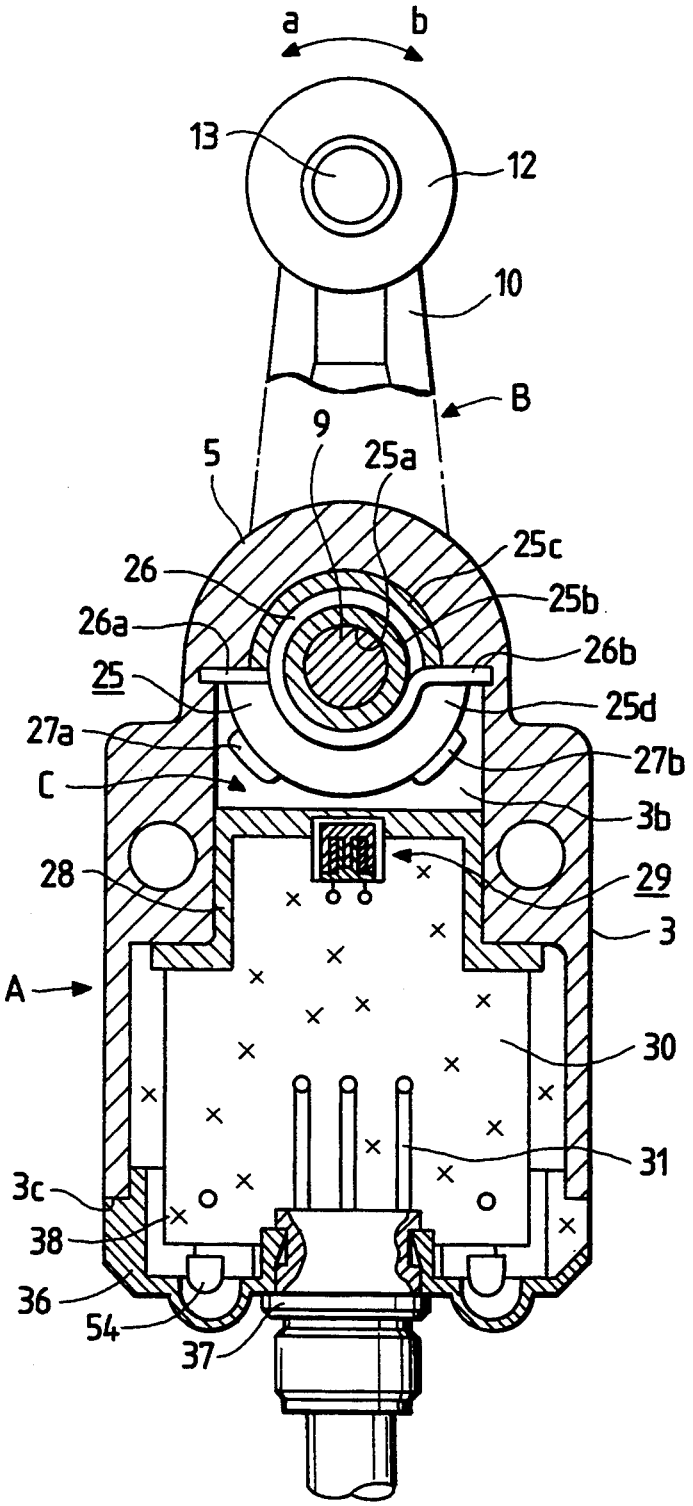
FIG. 2 is a front view, with parts cut away, showing essential components of the first embodiment.
Figure 3:
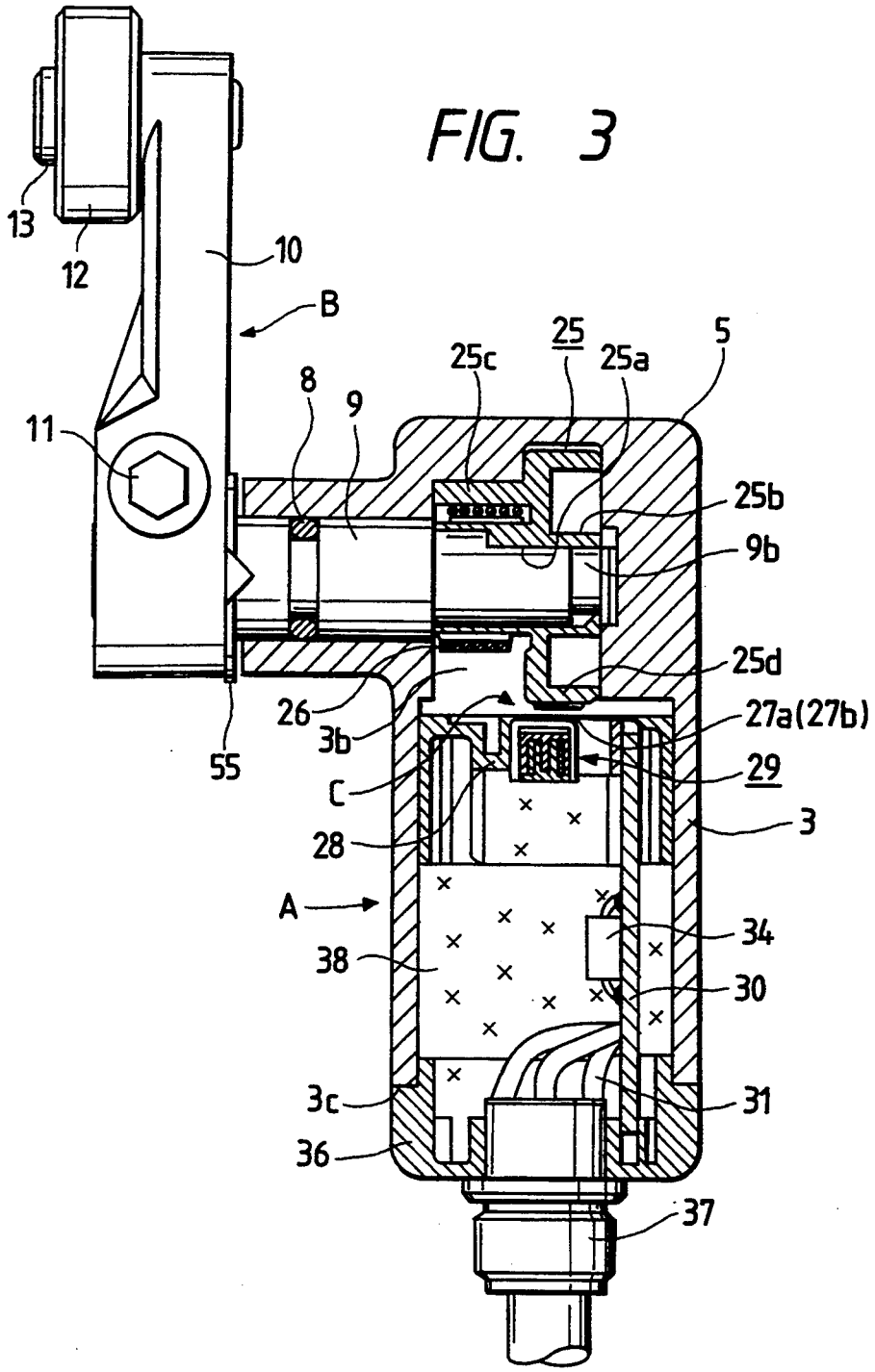
FIG. 3 is a side view, with parts cut away, showing essential components of the first embodiment.

The housing A, as shown in FIGS. 2 and 3 comprises: a tubular switch housing 3; and a head housing 5 which is integral with one end opening 3*b* of the housing 3. A shaft hole 6 is formed in one side of the head housing 5, into which a rotary shaft 9 is inserted. The rotary shaft 9 is rotatably fitted through an O-ring 8 in the shaft hole 6 of the head housing 5 in such a manner theft one end portion 9*a* of the rotary shaft 9 is extended outside the head housing 5. An actuator 10 together with a spacer 55 is mounted on the one end portion 9*a* of the rotary shaft in such a manner that the spacer 55 is located between the actuator and the head housing. The actuator thus mounted is fixed with a screw 11. The actuator 10 includes a shaft member 13, on which a roller 12 is mounted.

The other end portion 9*b* of the rotary shaft 9 is inserted into a cam 25. The cam 25 comprises: a boss 25*b* defining a shaft hole 25*a* into which the other end portion 9*b* of the rotary shaft 9 is inserted; an arcuate spring-receiving protrusion 25*c* which is coaxial with the boss 25*b* and radially spaced a predetermined distance from the boss 25*b;* and a cam protrusion 25*d* protruded radially from the outer cylindrical wall of the boss 25*b*. A pair of electrically conductive parts 27*a* and 27*b* which is to be detected (hereinafter referred to as "particular detection parts 27*a* and 27*b*", when applicable) are mounted on the outer cylindrical surface of the cam protrusion 25*d* in such a manner that they are circumferentially spaced a predetermined distance from each other.

A return spring 26, which is a coiled spring, is coaxially wounded on the boss 25*b* of the cam 25 with its two ends engaged with locking grooves formed in the inner surface of the head housing 5. The return spring 26 is elastically interposed between the inner sur face of the head housing 5 and the cam 25 to give a rotational return force to the rotary shaft 9 and hold the rotary shaft 9 in a neutral position.

The switch section C is made up of a proximity switch. The proximity switch comprises: a switch casing 28; a detector 29 mounted on the inner surface of the casing 28; and a printed circuit board 30 on which predetermined electrical circuit elements such as an oscillation circuit and a signal processing circuit have been mounted.

Electrical elements forming the electrical circuit, and operation indicating light-emitting elements 54 are mounted on the printed circuit board 30. Lead wires 31 connected to the lead pattern of the printed circuit board are connected to a connector 37 mounted on a cover 36, so that they are extended outside the switch housing 3 through the lower end opening 3c.

The switch housing 3 is filled with synthetic resin 38 which is an electrically insulating material, so that the detector 29, the printed circuit board 30, etc. are molded with the resin.

Figure 4:
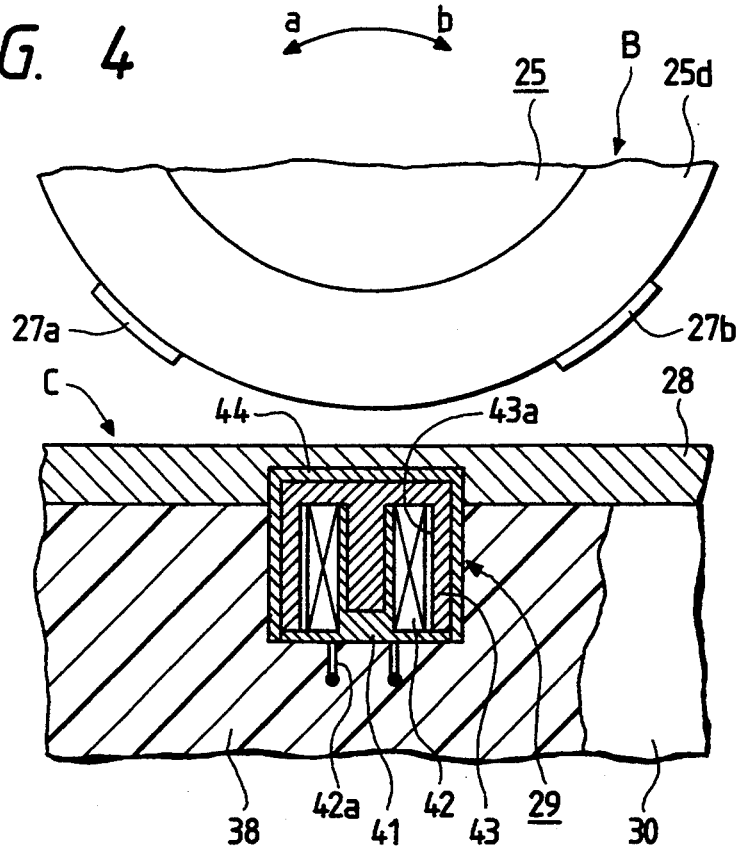
FIG. 4 is an enlarged sectional view showing essential components of the first embodiment.

The detector 29, as shown in FIG. 4, comprises: a coil spool 41 on which a detecting coil 42 has been wound; and a core 43 of magnetic material having an annular recess 43*a*, the core 43 being combined with the coil spool 41.

More specifically, the detecting coil 42 wound on the coil spool 41 is fitted in the annular recess 43*a* of the core 43. The leaders 42*a* of the coil 42 are electrically connected to predetermined electrical circuit elements, such as the aforementioned oscillation circuit and signal processing circuit, on the printed circuit board 30.

The operation of the limit switch thus organized will be described.

When a moving object abuts against the roller 12, the actuator 10 is turned clockwise or counterclockwise (in the direction of the arrow b or in the direction of the arrow a, respectively, as shown in FIG. 2), and accordingly the rotary shaft 9 together with the cam 25 is turned in the same direction.

As the cam 25 is turned, one of the particular detection parts 27*a* and 27*b* on the cam 25 approaches the detecting coil 42, which causes the inductance of the detecting coil 42 to change. The change in inductance is detected by the oscillation circuit, so that the oscillation circuit outputs a detection signal through the signal processing circuit. This detection signal is applied to the light emitting elements 54 so that this detecting operation can be visually confirmed with the aid of the light emitting elements 54.

In the limit switch, rotation of the rotary shaft 9 directly operates the proximity switch. This means that the limit switch can be formed without a mechanism which converts the rotational motion of the actuator 10 into a linear motion. Hence, the limit switch of the present invention, when compared with the conventional one, has fewer components can be miniaturized accordingly. In addition, in the limit switch of the present invention, the rotational operation section B is not in contact with the switch section C, and therefore the limit switch is free from unreasonable stress, which lengthens its service life.

Furthermore, in the limit switch, the housing A is made up of the switch housing 3 and the head housing 5 which are formed as one unit. Therefore, a sealed structure can be readily formed without providing an elastic seal member between the housings 3 and 5. The sealing effect can be greatly improved by filling the switch housing 3 with synthetic resin 38 through the end opening 3*c* in such a manner as to resin-mold the electrical elements therein.

In addition, the limit switch includes no mechanism for converting rotational motion into linear motion, which eliminates the difficulty that the space in the switch housing changes in volume and in pressure. Therefore, the unsatisfactory operation due to the unsteady returning operation of the actuator is eliminated; that is, the switching operation response is improved.

Figure 5:
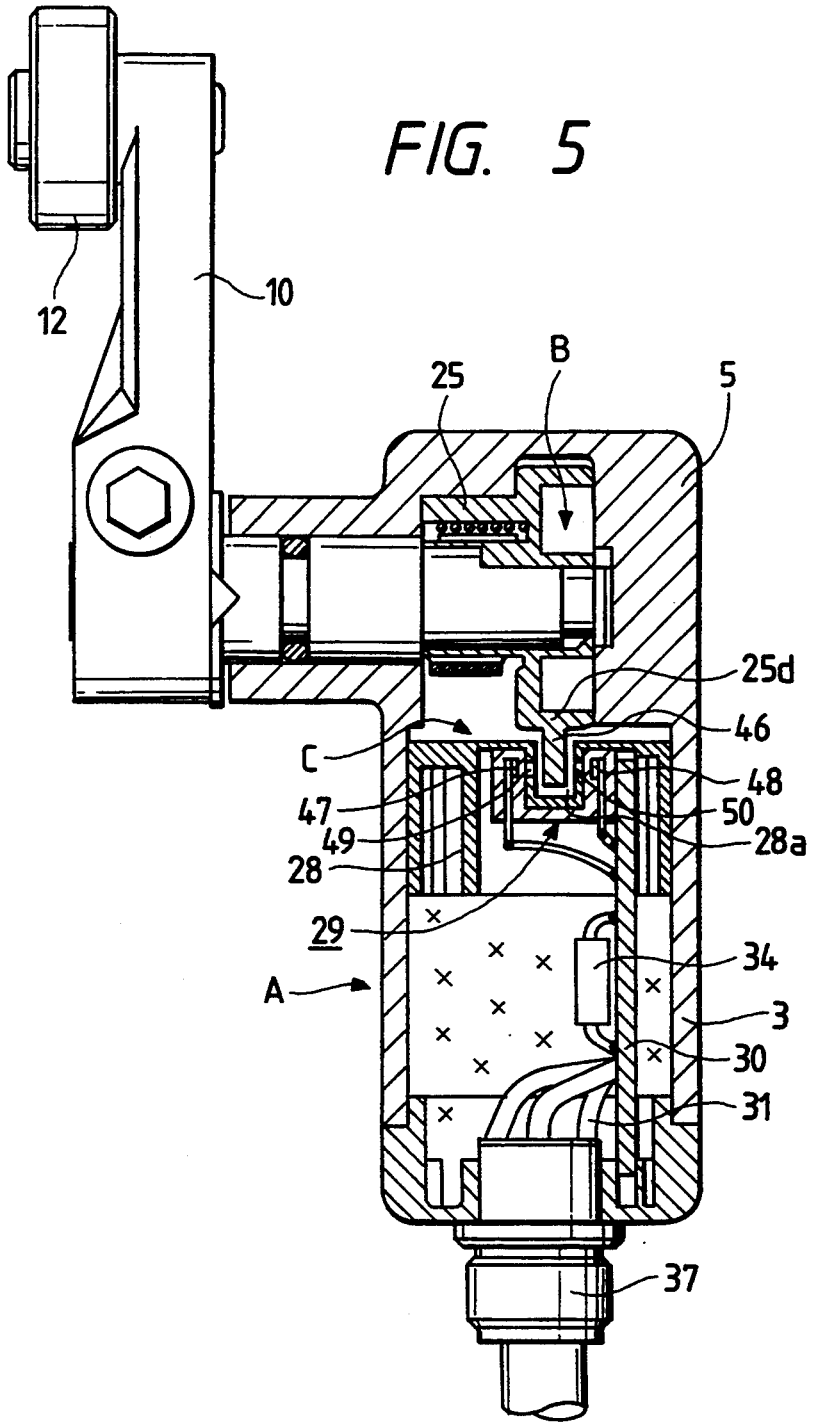
FIG. 5 is a side view, with parts cut away, showing essential components of a second embodiment of the invention.

In the above-described first embodiment, the switch section C is a proximity switch. However, the switch section C may be made up of a light-transmission type photo-electric switch as shown in FIGS. 5 and 6.

The photo-electric switch comprises: a switch casing 28 having a U-shaped recess 28*a;* and a detector 29 including a light emitting element 47 and a light receiving element 48. Those elements 47 and 48 are arranged in the switch casing 28 in such a manner that they are confronted with each other, so that, as shown in FIG. 6, a light beam 60 outputted by the light emitting element 47 is applied to the light receiving element 48 through through-holes 49 and 50 formed in the casing 28.

A light intercepting board 46 adapted to intercept the light beam 60 is rotatably provided in the above-described recess 28*a*. The light intercepting board 46 is extended from the cam 25 fixedly mounted on the other end portion 9*b* of the rotary shaft 9, and has a pair of through-holes 46*a* and 46*b* which are formed in it with a predetermined angular interval therebetween.

Figure 6:
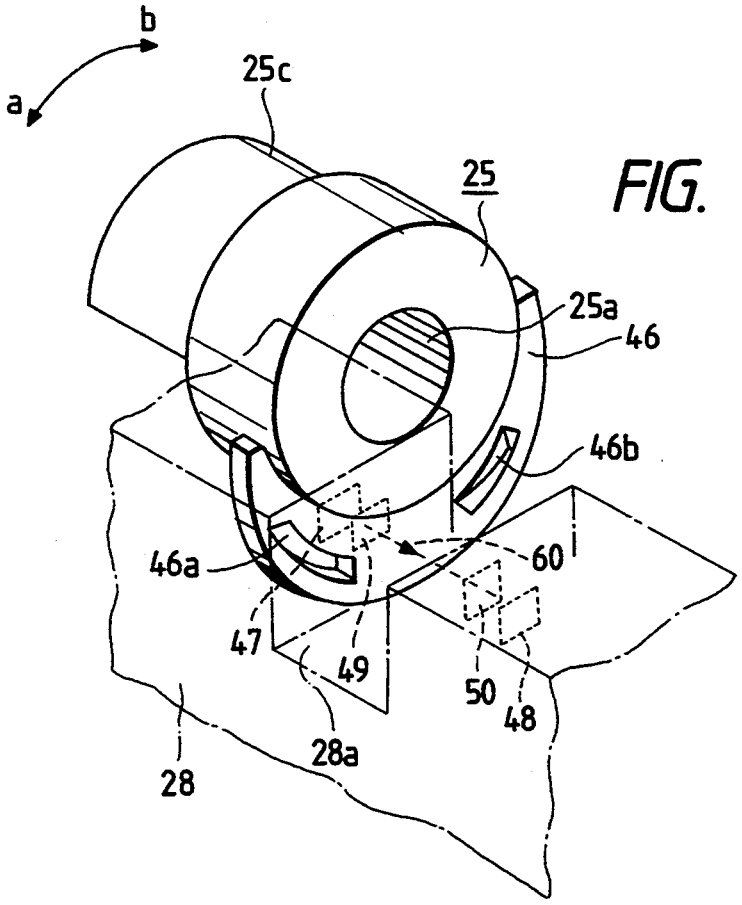
FIG. 6 is an enlarged perspective view showing essential components of the second embodiment.

When a moving object abuts against the roller 12, the actuator 10 together with the light intercepting board 42 is turned clockwise or counterclockwise (in the direction of the arrow b or in the direction of arrow a in FIG. 6), so that the light beam 60 is applied through one of the through-holes 46*a* and 46*b* to the light receiving element 48. The output signal of the light receiving element 48 is processed by the signal processing circuit on the printed circuit board, to provide a detection signal.

Figure 7:
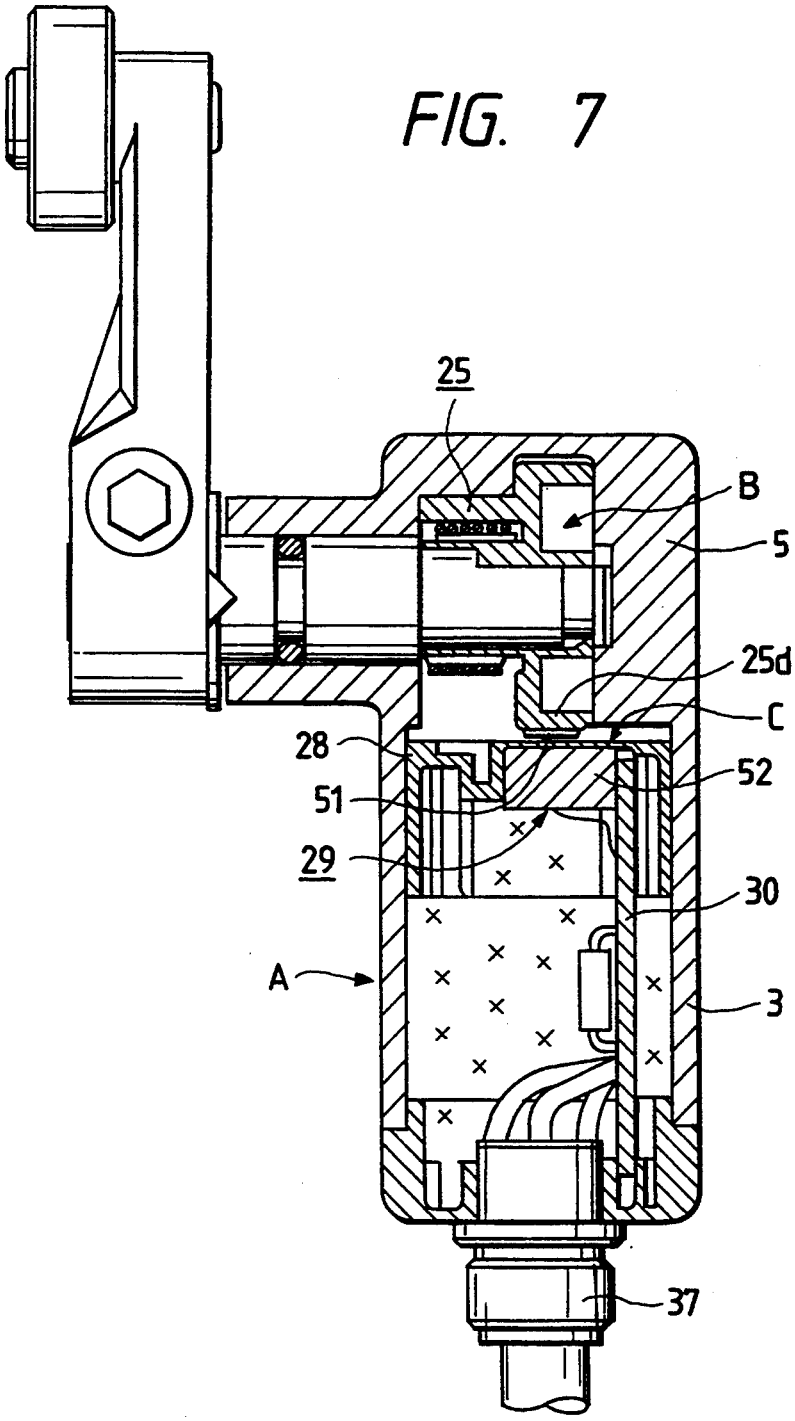
FIG. 7 is a side view, with parts cut away, showing essential components of a third embodiment of the invention.

The above-described switch section C may be made up of a detector 29 which, as shown in FIG. 7, includes a magneto-electric conversion element 52, such as a Hall element, provided on the printed circuit board 30.

That is, the magneto-electric conversion element 52 is built in the switch casing 28, and a magnet 51 for applying magnetic flux to the magneto-electric conversion element 51 is provided on the cam 25 which fixedly mounted on the other end portion of the rotary shaft 9.

When a moving object abuts against the roller 12, the actuator 10 together with the magnet 51 is turned. As a result, the electro-magnetic conversion element 52 is activated, so that a detection signal is provided with the aid of the signal processing circuit on the printed circuit board 30.

Figure 8:
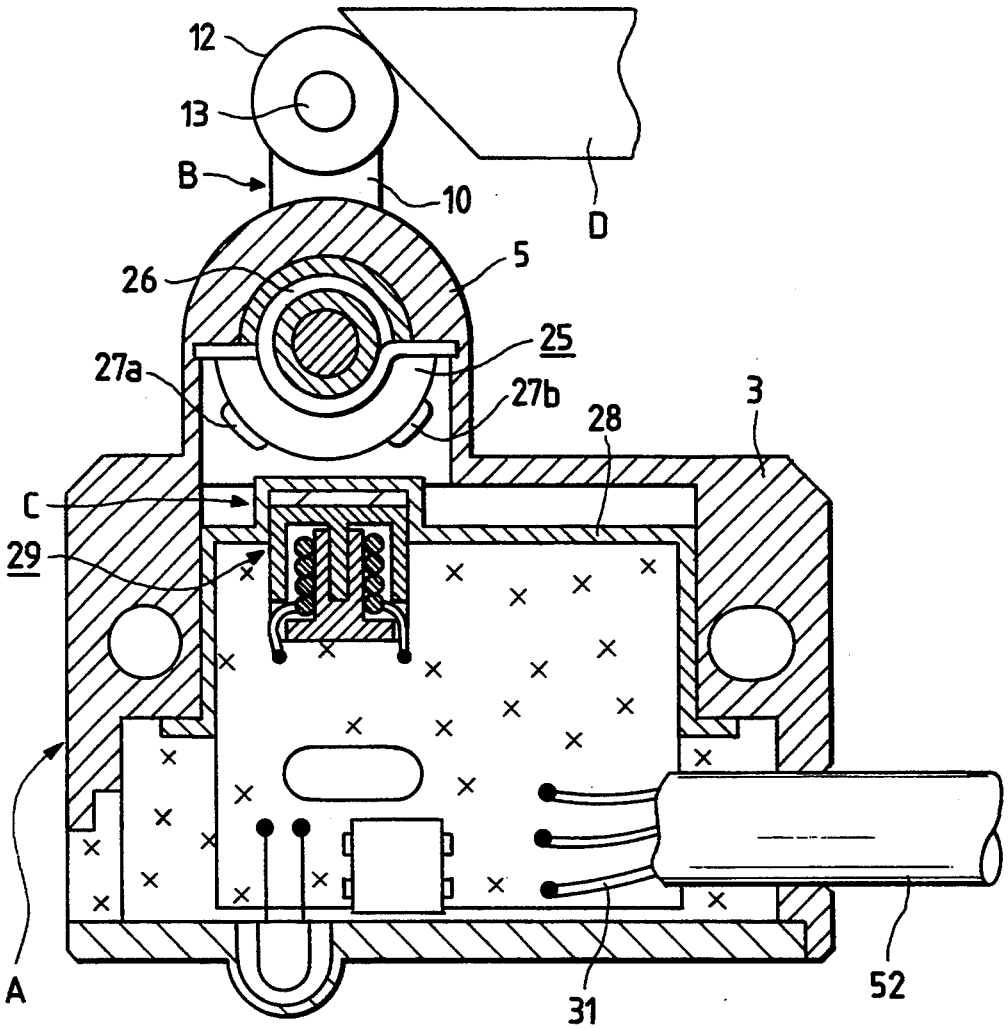
FIG. 8 is a front view, with arts cut away, showing essential components of a fourth embodiment of the invention.

The above-described limit switch may be so modified that, as shown in FIG. 8, the roller 2 is pushed by a dog D.

In the fourth embodiment using the dog D to push the roller 12, the switch section C is made up of a proximity switch similarly as in the first embodiment. However, it goes without saying that the above-described photo-electric switch or magneto-electric conversion switch may be employed.

In a fifth embodiment, each of the above-described embodiments may be modified as follows: A side opening (not shown), which is similar to the side opening 3*a* of the conventional limit switch shown in FIG. 24, is formed in one side of the switch housing 103, and it is closed with a cover. The fifth embodiment has the same effects as the first through fourth embodiments.

Figure 9:
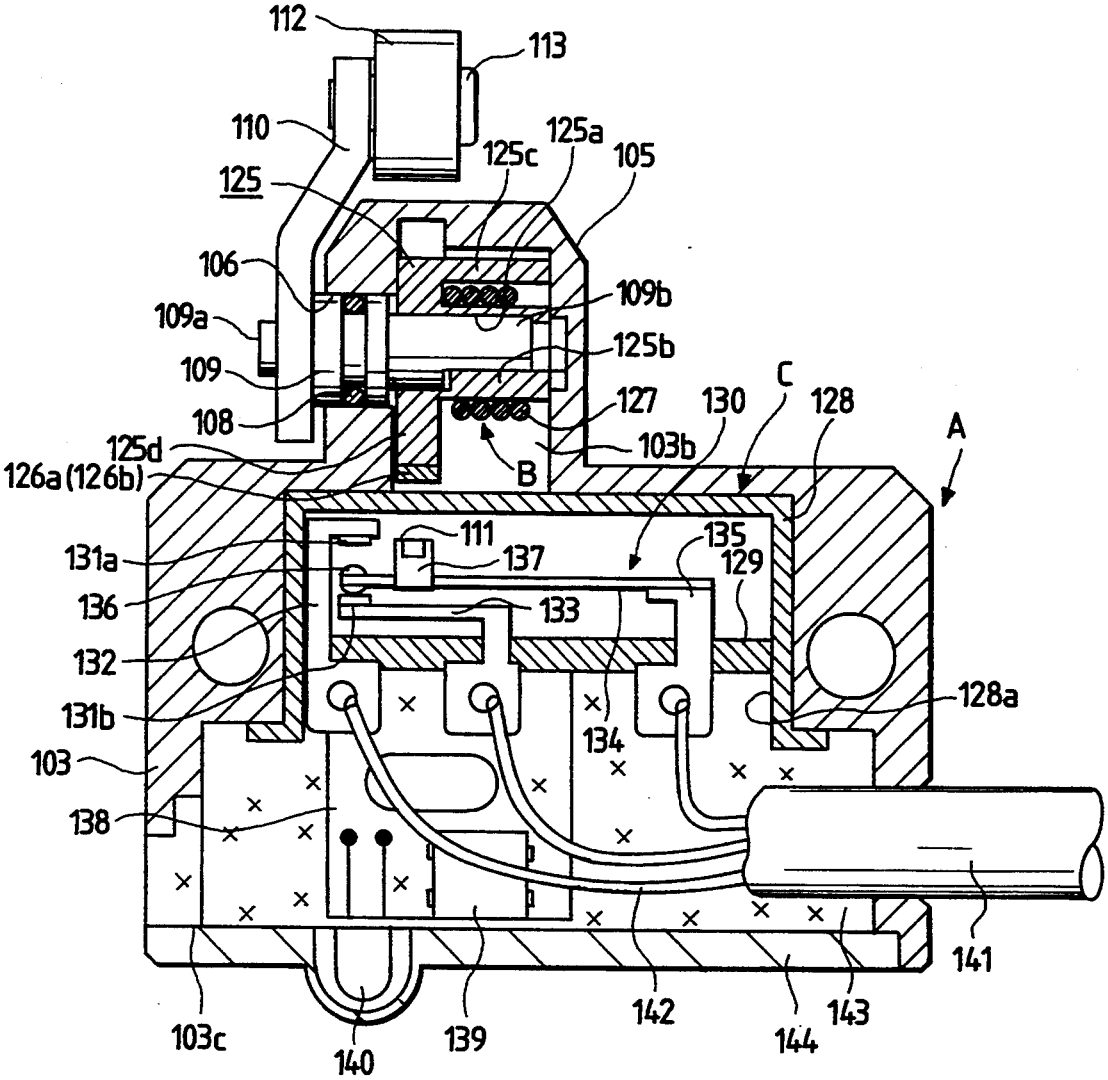
FIG. 9 is a side view, with parts cut away, showing essential components of a sixth embodiment of the invention.
Figure 10:
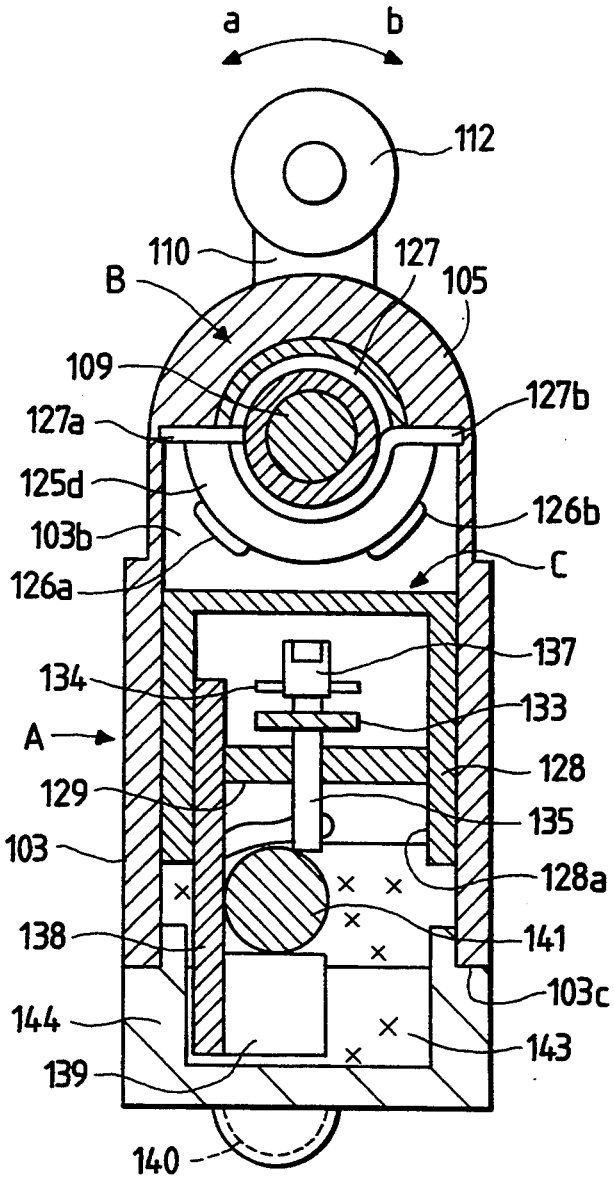
FIG. 10 is a front view, with parts cut away, showing essential components of the sixth embodiment.

FIGS. 9 and 10 show an example of a limit switch, which constitutes a sixth embodiment of the present invention.

As shown in FIG. 9, the limit switch comprises: a housing A; a rotational operation section B mounted in the upper portion of the housing A; and a switch section C provided in the lower portion of the housing A.

The housing A comprises: a tubular switch housing 103; and a head housing 105 which is integral with one end opening 103*b* of the housing 103. A shaft hole 106 is formed in one side of the head housing 105, into which a rotary shaft 109 is inserted. The rotary shaft 109 is rotatably fitted through an O-ring 108 in the shaft hole 106 of the head housing 105 so that one end portion 109*a* of the rotary shaft 109 is extended outside the head housing 105. An actuator 110 is mounted on and fixed to the one end portion 109*a* of the rotary shaft. The actuator 110 includes a shaft member 113, on which a roller 112 is mounted.

The other end portion 109*b*, of the rotary shaft 109 is inserted into a cam 125. The cam 125 comprises: a boss 125*b* defining a shaft hole 125*a* into which the other end portion 109*b* of the rotary shaft 9 is inserted; an arcuate spring-receiving protrusion 125c which is coaxial with the boss 125b and radially spaced a predetermined distance from the latter 125b; and a cam protrusion 125d protruded radially from the outer cylindrical wall of the boss 125b. As shown in FIG. 10, a pair of magnetic elements 126a and 126b are mounted on the outer cylindrical surface of the cam protrusion 125d so that they are circumferentially spaced a predetermined distance from each other.

A return spring 127, which is a coiled spring, is coaxially wounded on the boss 125b of the cam 125 with its two ends engaged with locking grooves formed in the inner surface of the head housing 105. The return spring 127 is elastically interposed between the inner surface of the head housing 105 and the cam 125 to give a rotational return force to the rotary shaft 109 and hold the rotary shaft 109 in neutral position.

The switch section C comprises a switch case 128, a terminal base 129 fittingly mounted onto a lower opening portion 128a of the switch case 128, and a contact mechanism 130 mounted on the base 129.

The switch mechanism 130 includes fixed terminals 132 and 133 respectively formed with fixed contacts 131a and 131b and a common terminal 135 on which movable contact piece 134 is fixed. The movable contact piece 134 is arranged such that a movable contact 136 provided on the contact piece 134 is confronted with the fixed contacts 131a and 131b. The movable contact 136 can be brought in contact with each of the fixed contact 131a and 131b. A magnet 137 is fixed onto the movable contact piece 134 so as to be confronted with an outer cylindrical surface of the cam protrusion 125d of the cam 125.

The switch section C is electrically connected to a printed circuit board on which predetermined electrical circuit elements such as a signal processing circuit or the like has been mounted.

Electrical elements 139 forming the electrical circuit, and operation indicating light-emitting elements 140 are mounted onto the printed circuit board 138 connected to lead wires 142 of cable 141 extending outside the switch housing 103.

The switch housing 103 is filled with synthetic resin 143 (as indicated by x) which is an electrically insulating material, so that portions of terminals 132, 133 and 135 extending downward from the terminal base 129 are molded with the resin. A cover 144 is fittingly secured to the lower opening portion 103c of the switch housing 103.

The operation of the limit thus organized will be described.

When a moving object abuts against the roller 112, the actuator 110 is turned clockwise or counterclockwise (in the direction of the arrow b or in the direction of the arrow a in FIG. 10), and accordingly the rotary shaft 109 together with the cam 125 is turned in the same direction.

As the cam 125 is turned, this way one of the magnetic elements 126a and 126b on the cam 125 approaches the magnet 137, which deflects the movable contact piece 134 by the virtue of the mutual magnetic attraction force therebetween. Accordingly, the contact mechanism 130 opens or closes so as to output a detection signal through the signal processing circuit. This detection signal is also applied to the light emitting elements 140 so that this detecting operation can be visually confirmed with the aid of the light emitting elements 140.

In the limit switch, rotation of the rotary shaft 109 directly operates the switch section C. This means that the limit switch can be formed without the mechanism which converts the rotational motion of the actuator 110 into a linear motion. Hence, the limit switch of the invention, when compared with the conventional one, has fewer components and can be miniaturized accordingly. In addition, in the limit switch of the invention, the rotational operation section B is not in contact with the switch section C, and therefore the limit switch is free from unreasonable stress which lengthens its service life.

Furthermore, in the limit switch, the housing A is made up of the switch housing 103 and the head housing 105 which are formed as one unit. Therefore a sealing structure can be readily formed without providing an elastic seal member between the housings 103 and 105. The sealing effect can be greatly improved by filling the switch housing 103 with synthetic resin 143 through the end opening 103c in such a manner as to resin-mold the terminal portions of the switch section C therein.

In addition, the limit switch does not include a mechanism for converting rotational motion into linear motion, which eliminates the difficulty that the space in the switch housing changes in volume and in pressure. Therefore, the unsatisfactory operation due to the unsteady returning operation of the actuator is eliminated; that is, the switching operation response is improved.

Moreover, the aforementioned switch mechanism 130 have a contact switch construction with the movable contact piece 134, so that high-current flow/interrupt operation can be achieved.

In addition, in the sixth embodiment, a magnet which is attracted to or repulsed from the magnet 137 may be used in place of each of magnetic member 126a and 126b. In this case, the magnet 137 may be replaced with a magnetic member.

The above-described embodiments may be modified as follows: A side opening (not shown), which is similar to the side opening 3a of the conventional limit switch shown in FIG. 24, may be formed in one side of the switch housing 103 and closed with a cover.

Figure 11:
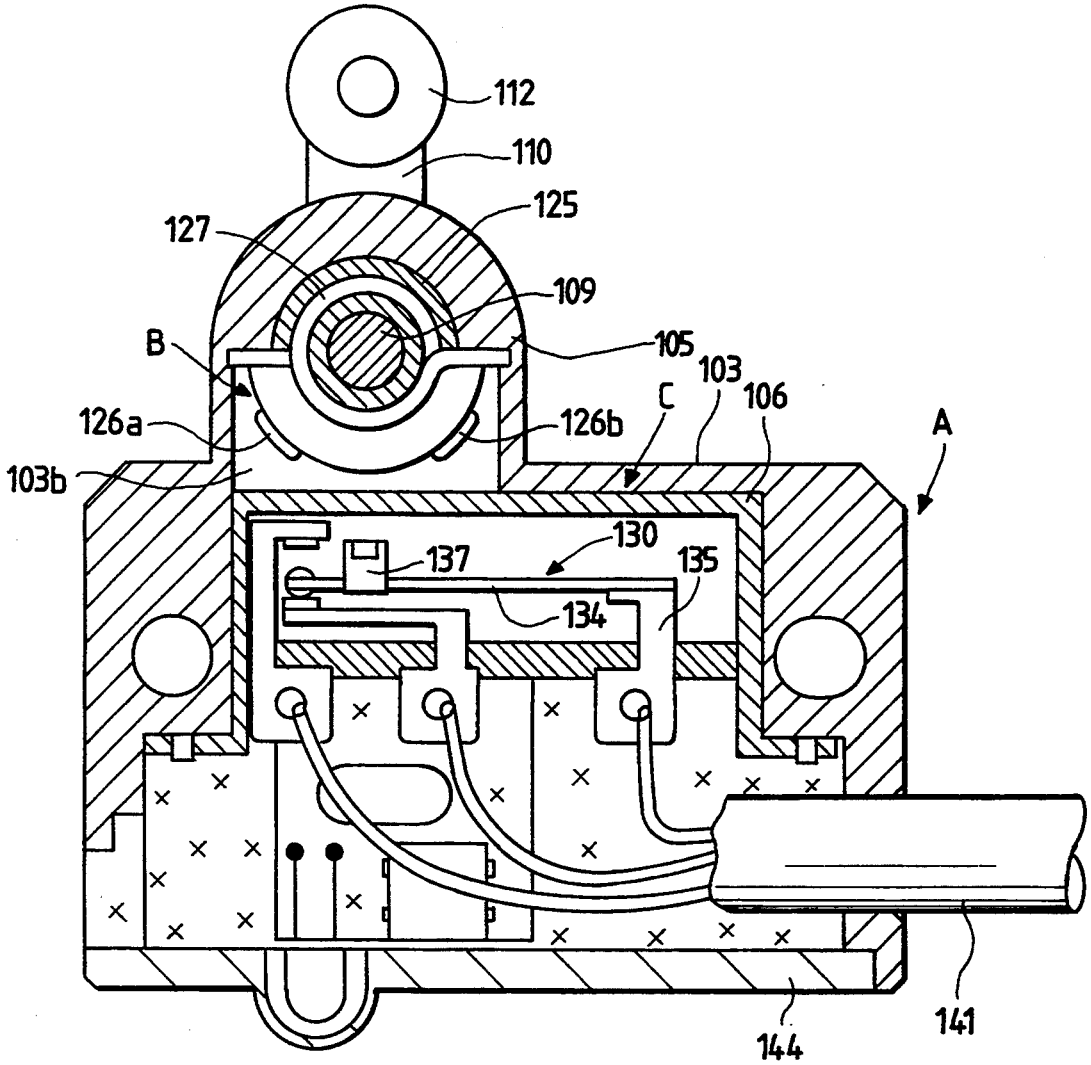
FIG. 11 is a front view, with parts cut away, showing essential components of a seventh embodiment of the invention.

In the seventh embodiment, the contact mechanism 130 is arranged such that a movable contact piece 134 is extended in a longitudinal direction parallel to the rotary shaft 109. However the movable contact piece 134 may be arranged to extend in the longitudinal direction perpendicular to the rotary shaft 109 as shown in FIG. 11.

Figure 12:
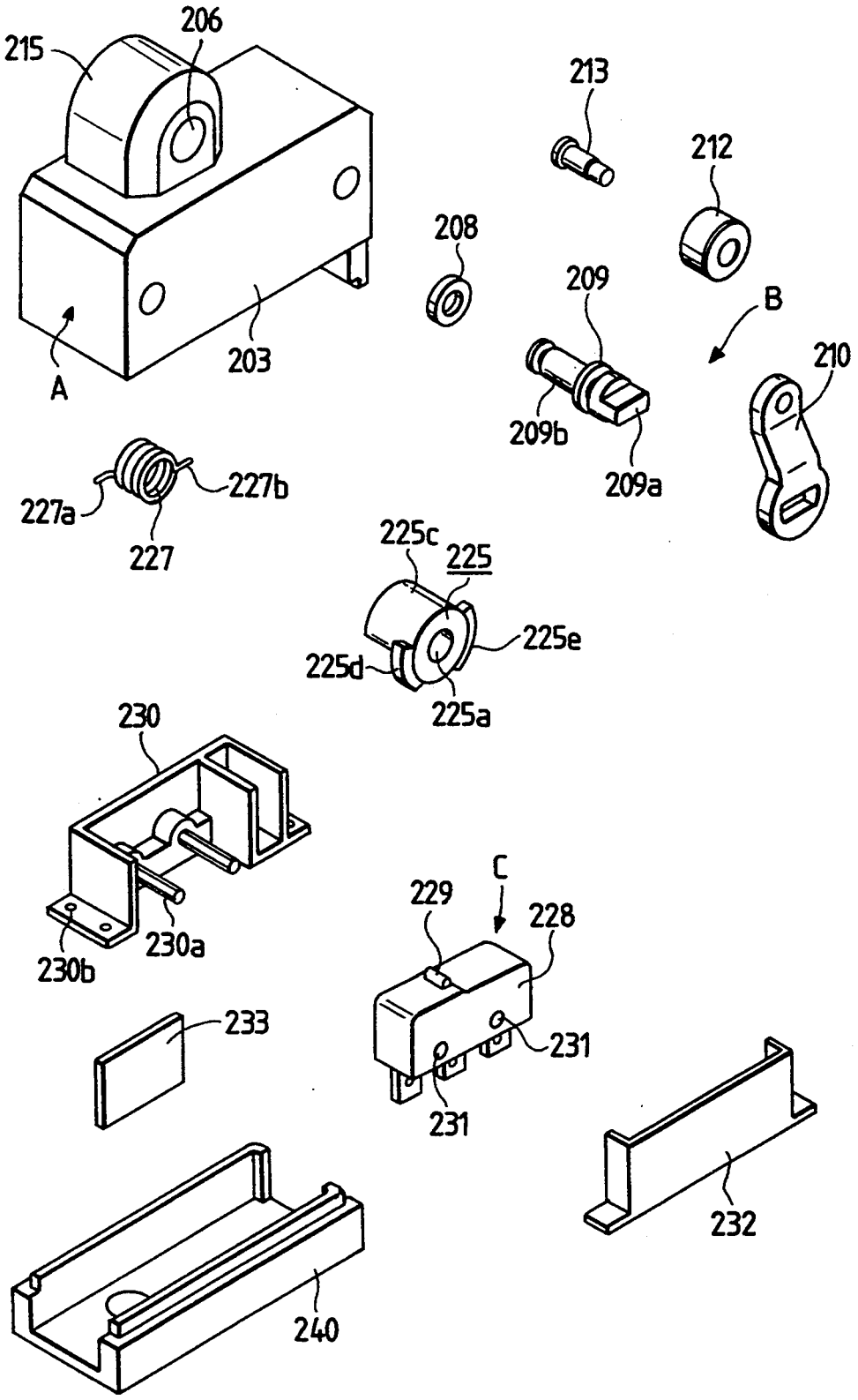
FIG. 12 is an exploded perspective view showing the arrangement of an eighth embodiment of the invention.
Figure 13:
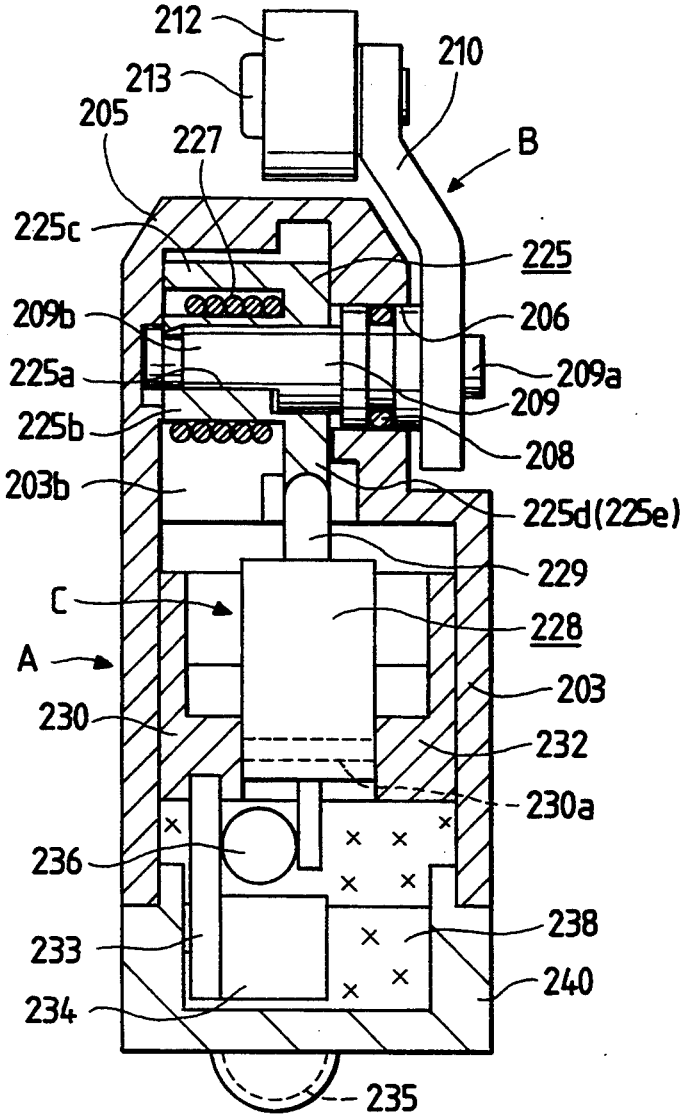
FIG. 13 is a side view, with parts cut away, showing essential components of the eighth embodiment.
Figure 14:
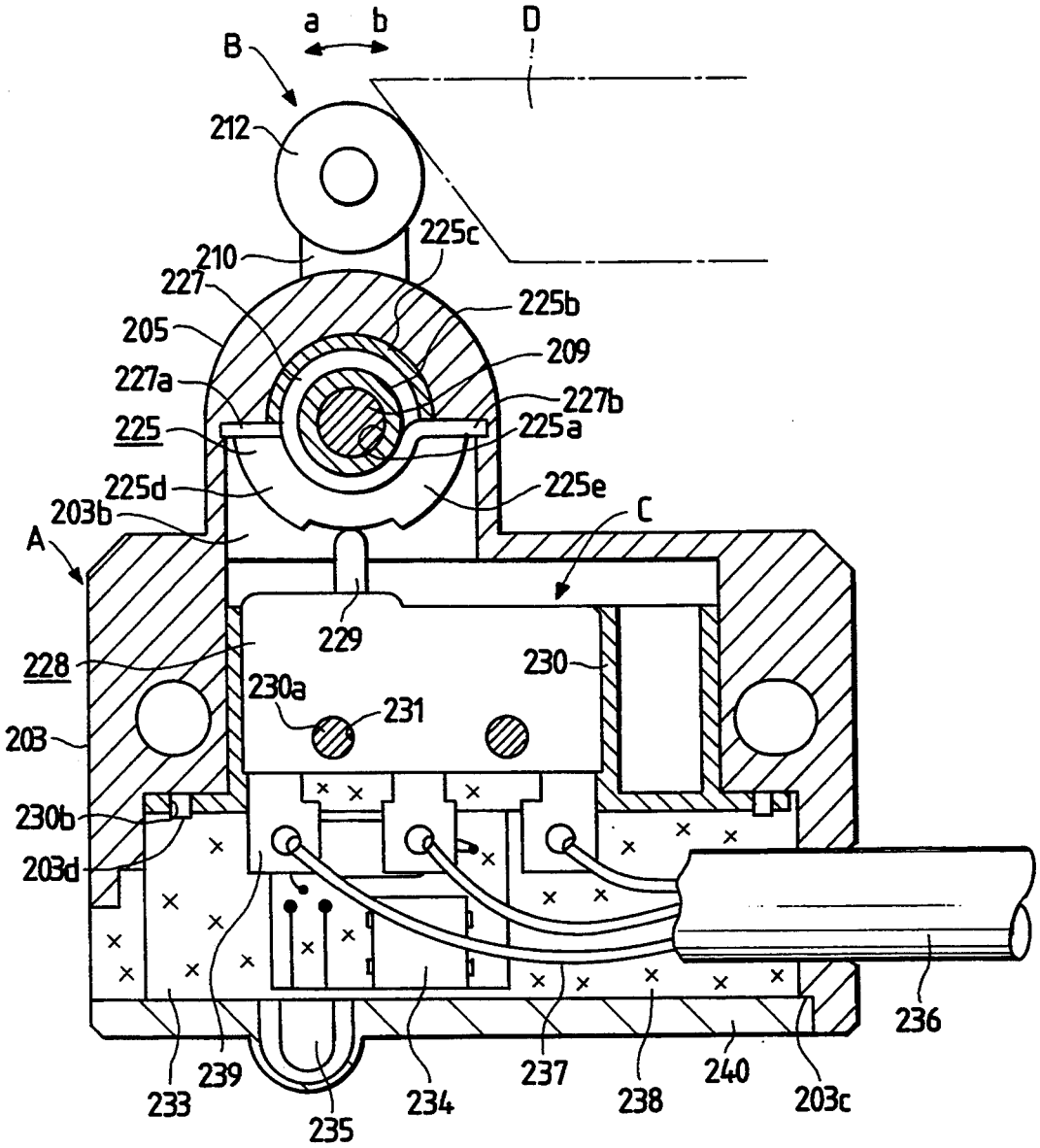
FIG. 14 is a front view, with parts cut away, showing essential components of the eighth embodiment.
Figure 15:
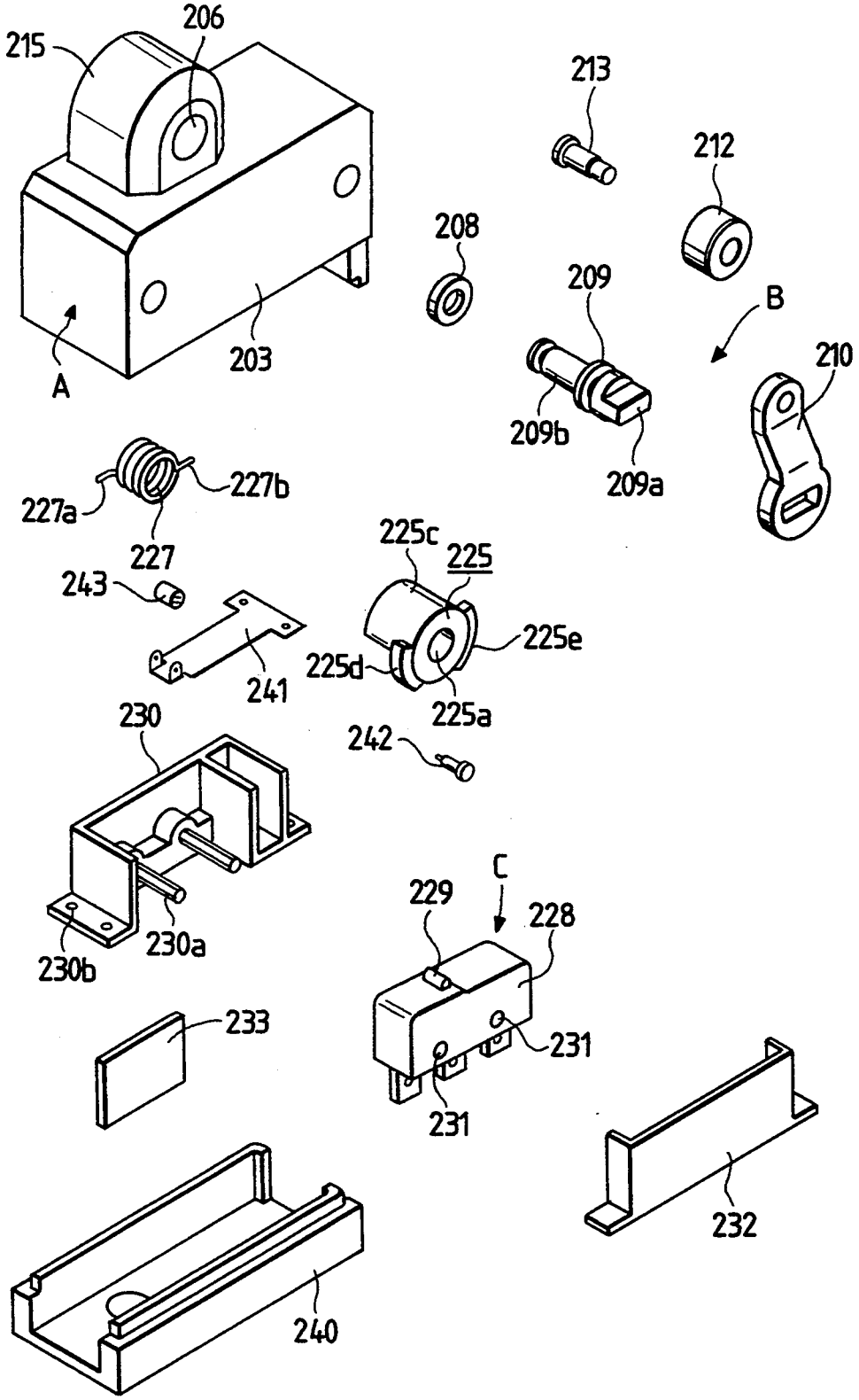
FIG. 15 is an exploded perspective view showing the arrangement of a ninth embodiment of the invention.
Figure 16:
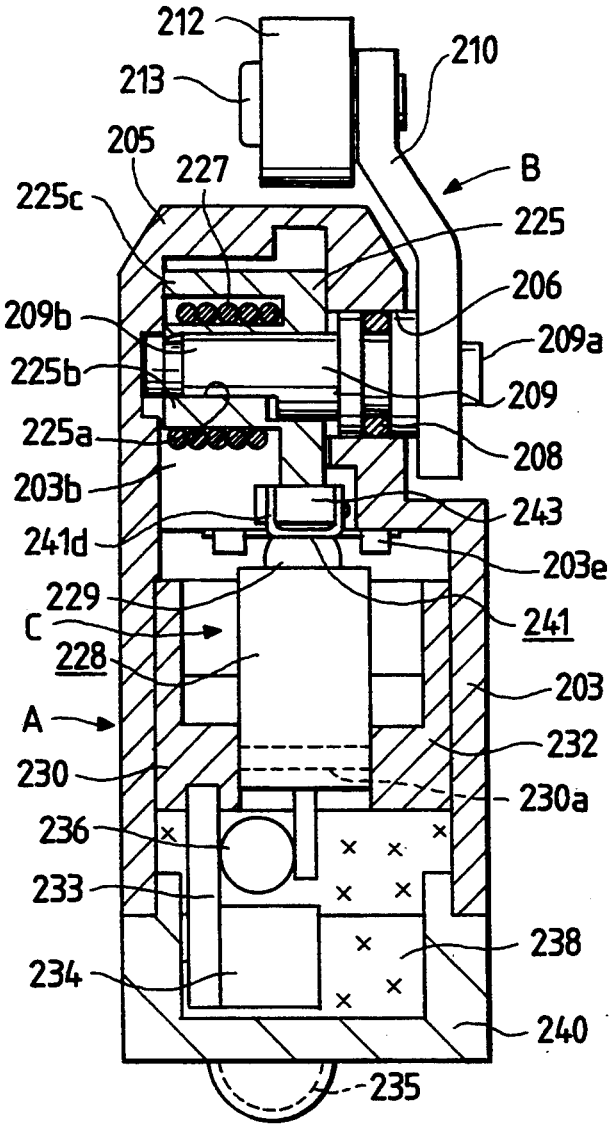
FIG. 16 is a side view, with parts cut away, showing essential components of the ninth embodiment.

FIGS. 12 to 14 show an eighth embodiment of the present invention. The basic construction of the eighth embodiment is similar to that of the aforementioned embodiments, so that only important or different portions thereof are described hereafter. In the eighth embodiment, the cam protrusion is divided into two arc-shaped cam protrusions 225d and 225e each of which is protruded radially from the outer cylindrical wall of the boss 225b.

The switch section C is made up of a microswitch 228 having a contact mechanism which opens and closes by depressing a pressure member 229. The contact mechanism (not shown) is installed in a switch case. Each mounting hole 231 formed in the switch case is fitted onto a corresponding projecting piece 230a provided on a switch holder 230 so that the microswitch 228 is held in place. The opening on one side of the holder 230 is closed by a cover 232. The switch holder 230 thus assembled with the microswitch 228 and the cover 232 is fixed to the switch housing 203 by caulking projections 203*d* projected from an inner wall of the switch housing 203 and inserted into respective mounting holes 230*b*.

The switch section C is electrically connected to a printed circuit board 233 on which an electrical element 234 forming predetermined circuit, an operation indicating light-emitting element 235 and so on are mounted.

When a moving object such as a dog D abuts against the rollers 212, the actuator 210 is turned clockwise or counterclockwise (in the direction of the arrow b or in the direction of the arrow a, respectively as shown in FIG. 14), and accordingly the rotary shaft 209 together with cam 225 is turned in the same direction.

As the cam 225 is turned, one of cam protrusions 225*d* and 225*e* abuts against the pressure member 229 to open/close the contact mechanism in the microswitch case, so that a detection signal is output, through the signal processing circuit. This detecting operation can be visually confirmed with the aid of the light emitting element to which the detection signal is applied.

Since the cam 225 in the rotational operation section B directly depresses the pressure member 229 of the microswitch 228 so that the limit switch is free from unreasonable stress which lengthens its service life.

The above-described embodiment may be modified as follows: A side opening (not shown), which is similar to the side opening 3*a* of the conventional limit switch shown in FIG. 24, is formed in one side of the switch housing 203, and closed with a cover.

FIGS. 15 to 18A show a ninth embodiment of the present invention. This embodiment is similar to the above-mentioned eighth embodiment, but is different therefrom in that a swingable lever 241 is provided between the cam 225 and the microswitch 228. The swingable lever 241 for depressing the pressure member 229 is fixed or onto the switch housing 203 by caulking projections 203*e* provided on the inner wall of the switch housing 203 and inserted into respective mounting holes 241*b* shown in FIG. 18. The swingable levers 241 is provided at its distal end 241*c* with bearing pieces 241*d* on which a roller 243 is mounted through a pin 242.

Figure 17:
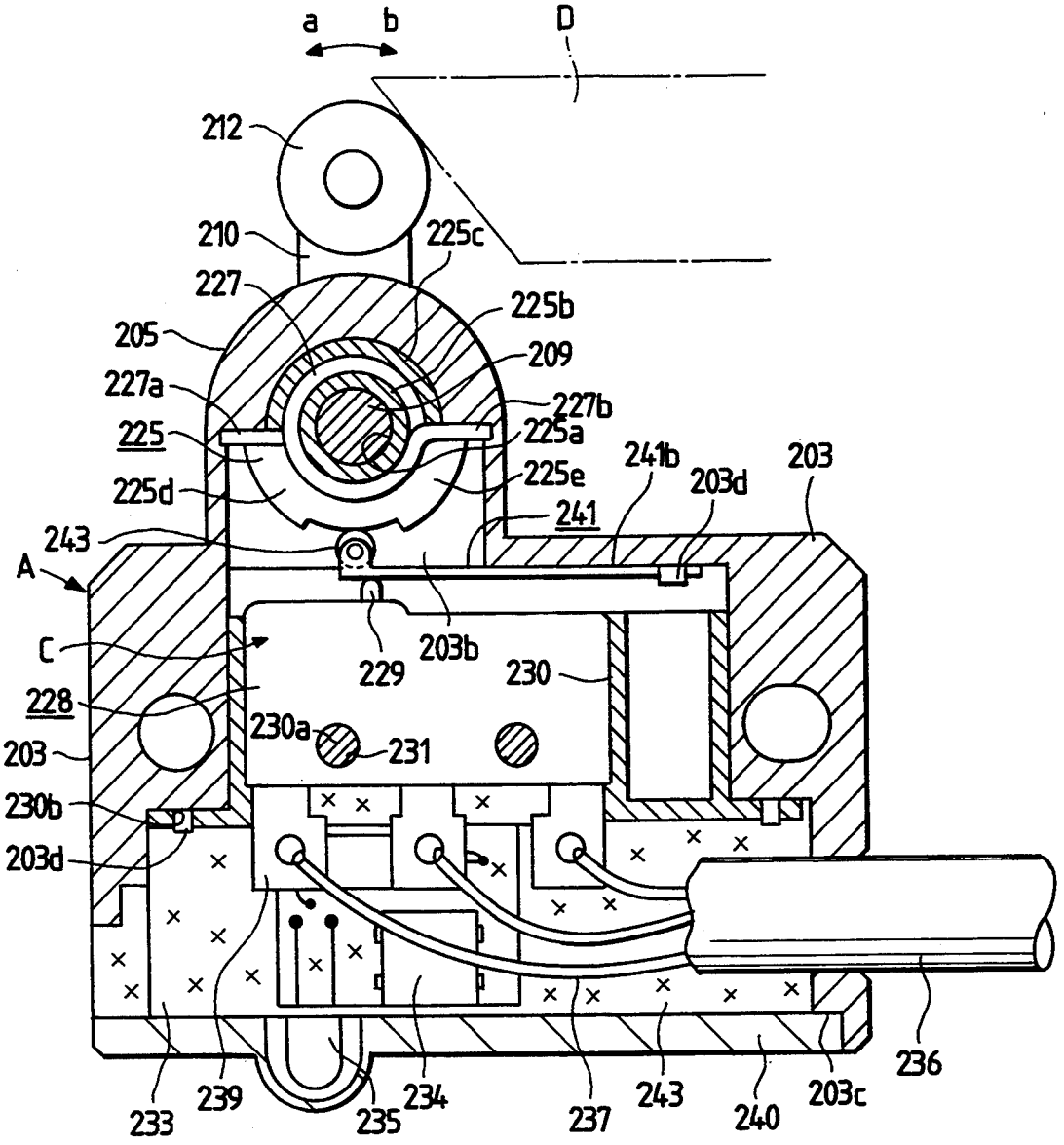
FIG. 17 is a front view, with parts cut away, showing essential component of the ninth embodiment.

When a moving object such as a dog D abuts against the rollers 212, the actuator 210 is turned clockwise or counterclockwise (in the direction of the arrow b or in the direction of the arrow a, respectively as shown in FIG. 17), and accordingly the rotary shaft 209 together with the cam 225 is turned in the same direction.

As the cam 225 is turned, one of cam protrusions 225*d* and 225*e* abuts against the roller 243, which causes the swingable lever 241 to be displaced to depress the pressure member 229 to open/close the contact mechanism in the microswitch case. Therefore, a detection signal is output through the signal processing circuit. This detecting operation can be visually confirmed with the aid of the light emitting element to which the detection signal is applied.

Since the cam 225 in the rotational operation section B with the aid of swingable lever 241 depresses the pressure member 229 of the microswitch 228, the limit switch is free from unreasonable stress, which lengthens its service life.

The above-described embodiment may be modified as follows: A side opening (not shown), which is similar to the side opening 3*a* of the conventional limit switch shown in FIG. 24, is formed in one side of the switch housing 203 and closed with a cover.

Figure 18A:
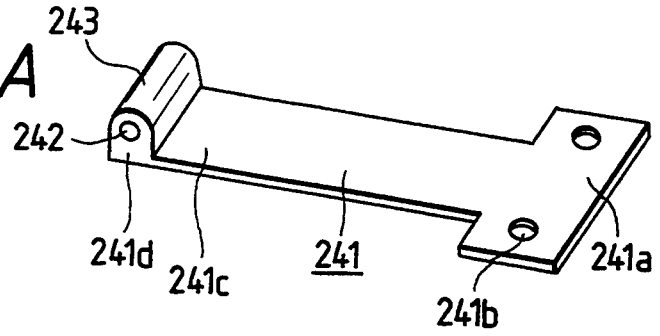
FIG. 18A is an enlarged perspective view showing a swingable lever in the ninth embodiment.
Figure 18B:
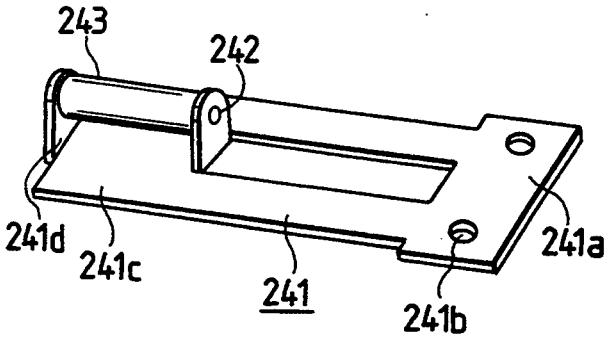
FIG. 18B is an enlarged perspective view showing a swingable lever in a tenth embodiment of the present invention.
Figure 19:
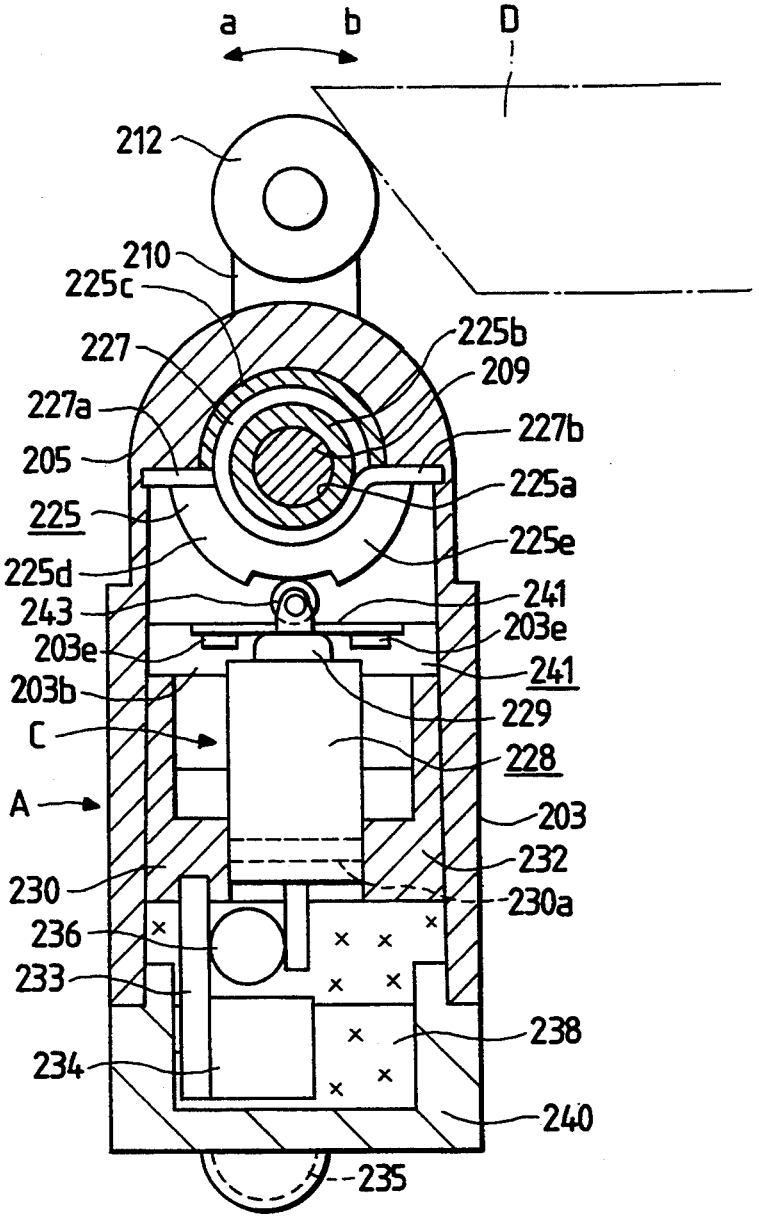
FIG. 19 is a front view, with parts cut away, showing essential components of the tenth embodiment.
Figure 20:
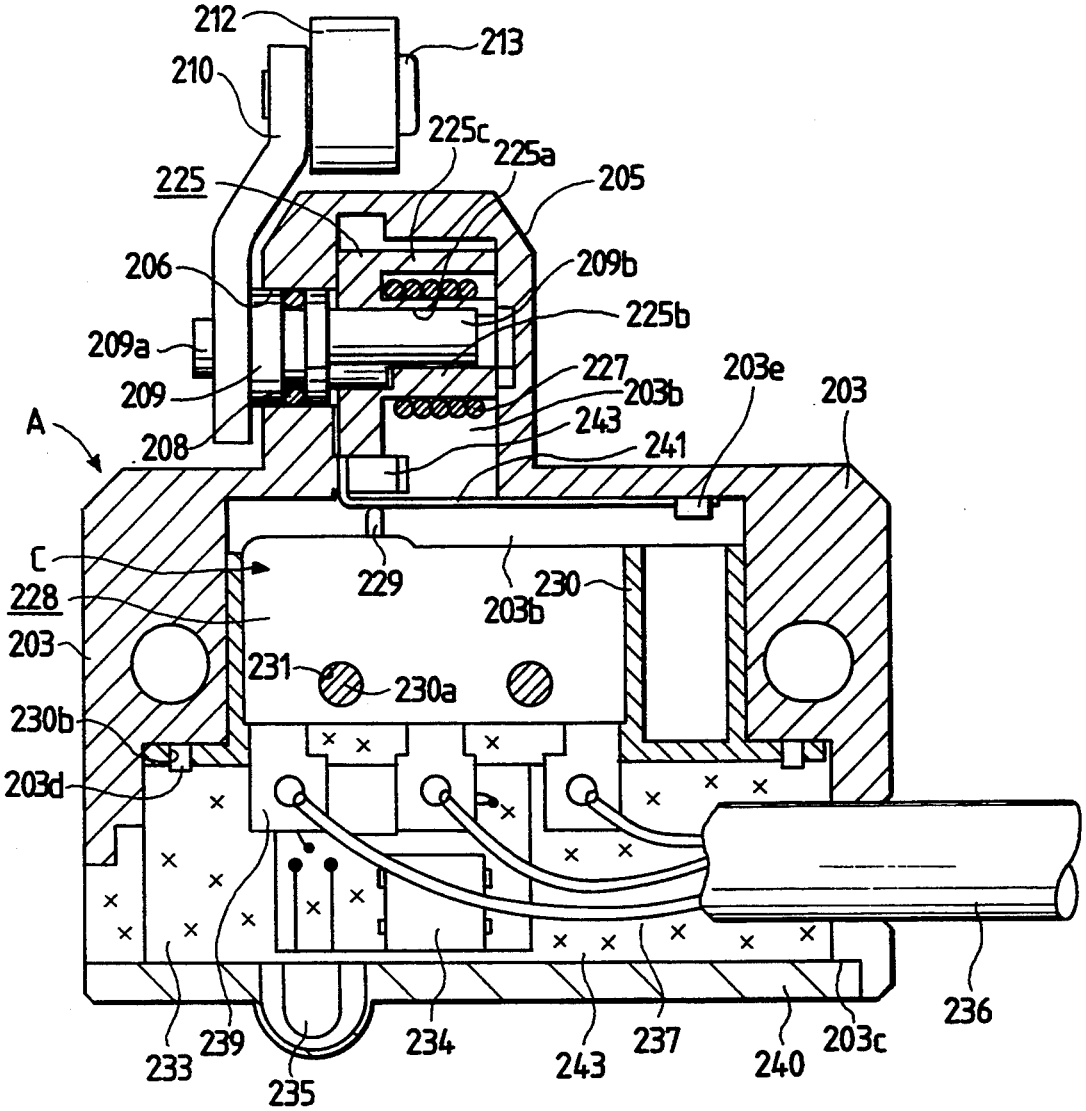
FIG. 20 is a side view, with parts cut away, showing essential components of the tenth embodiment.

In the aforementioned ninth embodiment, the swingable lever 241 is extended in the longitudinal direction perpendicular to the rotary shaft 209. However, in a tenth embodiment, as shown in FIGS. 19 and 20, the swingable member 241 may be extended in the longitudinal direction parallel to the rotary shaft 209, provided that the roller 243 is mounted on the distal end 241*c* of the swingable lever 241 perpendicularly to the longitudinal direction of the swingable lever 241 as shown in FIG. 18B.

Figure 21:
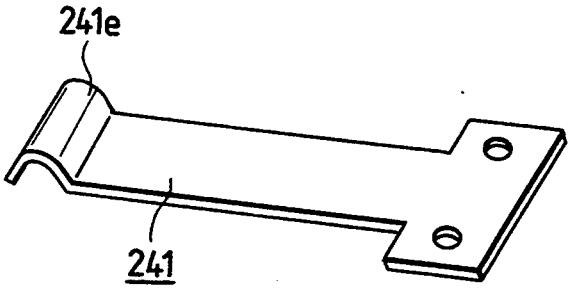
FIG. 21 is a perspective view showing another example of the swingable lever used in the ninth embodiment.
Figure 22:
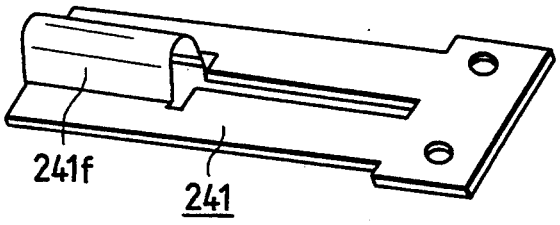
FIG. 22 is a perspective view showing another example of the swingable lever used in the tenth embodiment.

In addition, if the distal end of the swingable lever 241 forms a semicylindrical projection 241*e*, 241*f* as shown in FIGS. 21 and 22, the roller 243 is not needed.

Figure 23:
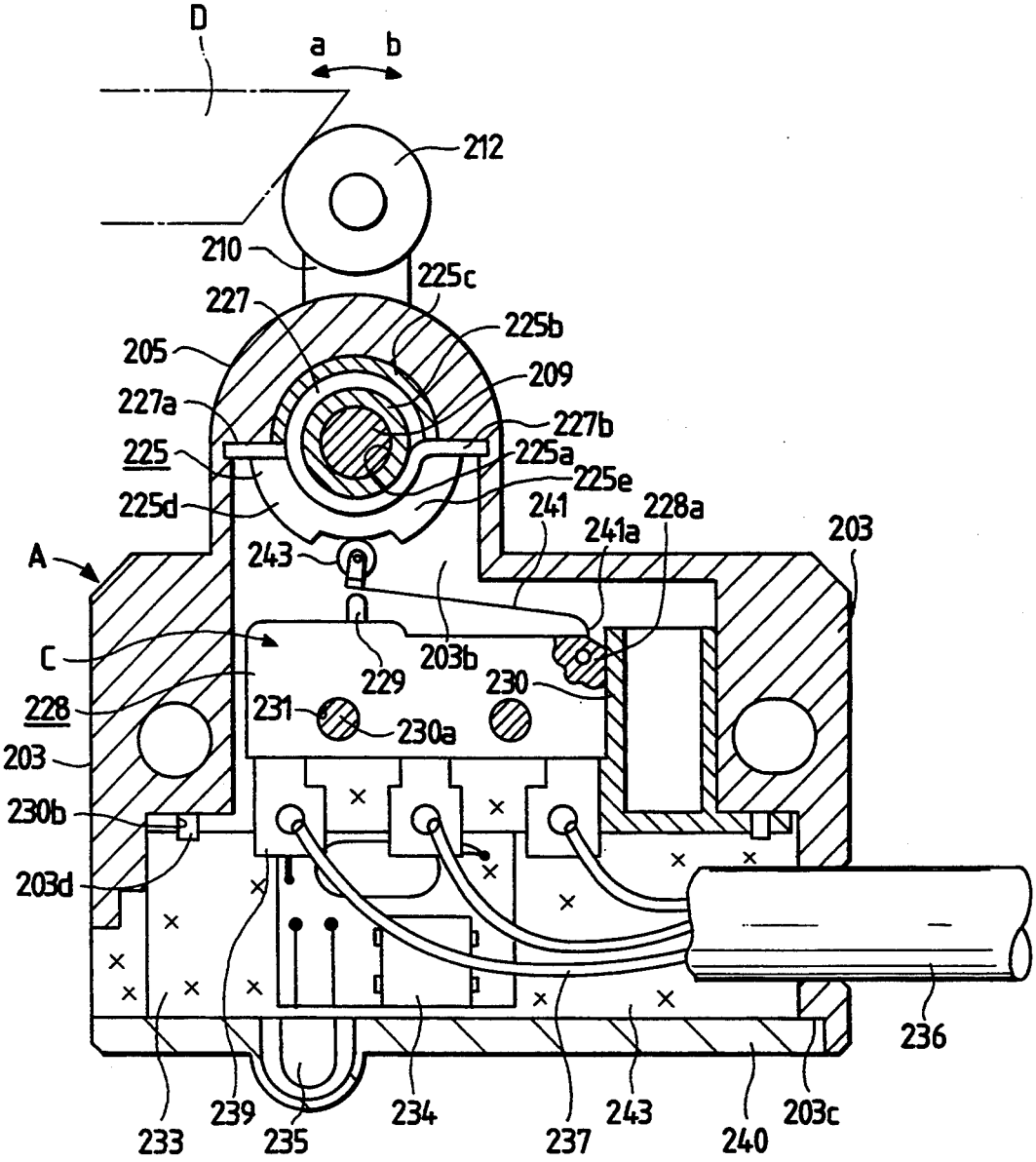
FIG. 23 is a front view, with parts cut away, showing essential components of an eleventh embodiment of the invention.

In each of the ninth and tenth embodiments, a distal end 241*a* of the swingable lever 241 is fixed to the inner wall of the switch housing 203, but it may be also supported by a microswitch case 228*a* as shown in FIG. 23. In the eleventh embodiment, the swingable lever 241 may be formed as a separate member from the microswitch case 228*a*, or otherwise may be provided integrally with the microswitch case 228*a*.

As explained along various embodiments, in the limit switch of the present invention, the rotational motion of the rotary shaft is directly detected by the detector to perform a switch operation or the switch operation is performed directly by the rotational motion of the rotary shaft. Therefore, it is unnecessary for a limit switch to employ a mechanism which converts the rotational motion of the actuator into a linear motion. Hence, the limit switch of the present invention, when compared with the conventional one, has fewer components and can be miniaturized according. In addition, when the limit switch of the present invention is constructed so that the rotational operation section is not in con tact with the switch section, the limit switch is free from unreasonable stress, which increases its service life. When the movable and fixed contact construction is used, the limit switch can perform a high-current flow-/interrupt switch operation. Furthermore, the housing of the limit switch is made up of the switch housing, and the head housing which are formed as one unit. Therefore, a sealed structure can be readily formed without providing an elastic seal member between the two housings. In addition, the limit switch does not include a mechanism for converting rotational motion into linear motion, which eliminates the difficulty that the space in the switch housing changes in volume and in pressure. Therefore, the unsatisfactory operation due to the unsteady returning operation of the actuator is eliminated; that is, the switching operation response is improved.

What is claimed is:

1. A limit switch comprising:

a housing comprising an upper mechanical housing having an interior chamber and a lower switch housing having an interior chamber in communication with said interior chamber of said upper mechanical housing;

a rotational operation section accommodated in a portion of said upper mechanical housing, said rotational operation section comprising:

a rotary shaft having two ends, each end being rotatably supported by said upper portion of said housing so that one end of said rotary shaft extends outside said housing, an actuator fixed to said one end of said rotary shaft for turning said rotary shaft, and a cam, said cam being mounted on said rotary shaft and having at least one particular detection part on an outer cylindrical surface thereof;

a switch section accommodated in a portion of said lower switch housing and associated with said rotational operation section, wherein said switch section is mechanically separated from said rotational operation section; and a detector provided in said switch section for detecting said particular detection part.

2. A limit switch comprising:

a housing;

a rotational operation section accommodated in an upper portion of said housing comprising:

a rotary shaft having two ends, each end being rotatably supported by said upper portion of said housing so that one end of said rotary shaft extends outside said housing, and an actuator fixed to said one end of said rotary shaft for turning said rotary shaft;

a switch section accommodated in a lower portion of said housing and associated with said rotational operation section, wherein an interior chamber of said upper portion is in communication with an interior chamber of said lower portion and wherein said switch section is operated in non-contact relation to said rotational operation section;

a cam mounted on said rotary shaft, said cam having at least one particular detection part on an outer cylindrical surface thereof; and a detector provided in said switch section for detecting said particular detection part, wherein said particular detection part includes an electrically conductive part and said detector includes a coil, so that said switch section forms a proximity switch.

3. A limit switch comprising:

a housing;

a rotational operation section accommodated in an upper portion of said housing comprising:

a rotary shaft having two ends, each end being rotatably supported by said upper portion of said housing so that one end of said rotary shaft extends outside said housing, and an actuator fixed to said one end of said rotary shaft for turning said rotary shaft;

a switch section accommodated in a lower portion of said housing and associated with said rotational operation section, wherein an interior chamber of said upper portion is in communication with an interior chamber of said lower portion and wherein said switch section is operated in non-contact relation to said rotational operation section;

a cam mounted on said rotary shaft, said cam having at least one particular detection part on an outer cylindrical surface thereof; and a detector provided in said switch section for detecting said particular detection part, wherein said particular detection part includes at least one through hole formed in a light intercepting board extending from said cam; and said detector includes a light receiving element so that said switch section forms a light-transmission type photo-electric switch.

4. The limit switch as claimed in claim 1, wherein said particular detection part includes a magnet and said detector includes a magneto-electric conversion element.

5. The limit switch as claimed in claim 1, wherein said particular detection part includes a magnetic element and said detector includes a magnet mounted on a pivotably movable contact piece.

6. The limit switch as claimed in claim 1, wherein said rotational operation section and said switch section are isolated from each other in said housing by a switch casing provided inside said housing.

7. A limit switch comprising:

a rotational operation section having a rotary shaft and an actuator for turning said rotary shaft, said rotational operation section comprising a cam said cam having at least one particular detection part on an outer cylindrical surface thereof and mounted fixedly on said rotary shaft;

a switch section associated with said rotational operation section;

a one-piece housing comprising a tubular switch housing having two ends and an interior chamber and a head housing having an interior chamber in communication with said interior chamber of said switch housing, said switch housing and said head housing formed integrally together, wherein said head housing merges with a first end of said switch housing, said head housing sealingly encloses said rotational operation section such that one end of said rotary shaft projects outside said head housing, said switch housing substantially enclosing said switch section, and said switch section includes a detector provided within said switch housing for detecting said particular detection part in non-contact relation to said particular detection part to provide a detection signal; and a cover sealingly secured to a second end of said switch housing, said limit switch being formed by a process comprising the steps of:

(a) forming said housing having a lower opening;

(b) inserting component of said switch section and components of said rotational operation section into said housing through said lower opening in said housing; and (c) sealing said lower opening in said housing with said cover.

8. The limit switch as claimed in claim 7, wherein said switch housing is filled with synthetic resin.

9. The limit switch as claimed in claim 1, wherein said switch section of said lower switch housing is mechanically stationary.

10. A limit switch comprising:

a housing, comprising an upper mechanical housing having an interior chamber and a lower switch housing having an interior chamber in communication with said interior chamber of said upper mechanical housing;

a rotational operation section accommodated in a portion of said upper mechanical housing, said rotational operation section comprising:

a rotary shaft having two ends, each end being rotatably supported by said upper portion of said housing so that one end of said rotary shaft extends outside said housing, an actuator fixed to said one end of said rotary shaft for turning said rotary shaft, and a cam, said can being mounted on said rotary shaft and having at least one particular detection part on an outer cylindrical surface thereof;

a switch section accommodated in a portion of said lower switch housing and associated with said rotational operation section, wherein said switch section is mechanically separated from said rotational operation section; and a detector provided in said switch section for detecting said particular detection part, said limit switch being formed by a process comprising the steps of:

(a) forming said housing having a lower opening;

(b) inserting components of said switch section and components of said rotational operation section into said housing through said lower opening in said housing; and (c) sealing said lower opening in said housing with a lid.

11. A limit switch comprising:

a housing comprising an upper mechanical housing having an interior chamber and a lower switch housing having an interior chamber in communication with said interior chamber of said upper mechanical housing;

a rotational operation section accommodated in a portion of said upper mechanical housing, said rotational operation section comprising:

a rotary shaft having two ends, each end being rotatably supported by said upper portion of said housing so that one end of said rotary shaft extends outside said housing, an actuator fixed to said one end of said rotary shaft for turning said rotary shaft, and a cam, said cam being mounted on said rotary shaft and having at least one particular detection part on an outer cylindrical surface thereof;

a switch section accommodated in a portion of said lower switch housing and associated with said rotational operation section, wherein said switch section is mechanically separated from said rotational operation section; and a detector provided in said switch section for detecting said particular detection part, said limit switch being formed by a process comprising the steps of:

(a) forming said housing having a lower opening;

(b) inserting said cam and said switch section into said housing through said lower opening in said housing; and (c) sealing said lower opening in said housing with a lid.

12. A limit switch comprising:

a housing comprising an upper mechanical housing having an interior chamber and a lower switch housing having an interior chamber in communication with Said interior chamber of said upper mechanical housing;

a rotational operation section accommodated in a portion of said upper mechanical housing, said rotational operation section comprising:

a rotary shaft having two ends, each end being rotatably supported by said upper portion of said housing so that one end of said rotary shaft extends outside said housing, an actuator fix ed to said one end of said rotary shaft for turning said rotary shaft, and a cam, said cam being mounted on said rotary shaft and having at least one particular detection part on an outer cylindrical surface thereof;

a switch section accommodated in a portion of said lower switch housing and associated with said rotational operation section, wherein said switch section is mechanically separated from said rotational operation section; and a detector provided in said switch section for detecting said particular detection part, said limit switch being formed by a process comprising the steps of:

(a) forming said housing having a lower opening;

(b) inserting said cam into said housing through said lower opening in said housing;

(c) inserting a casing for separating said rotational operation section from said switch section into said housing through said lower opening in said housing; and (d) sealing said lower opening of said housing with a lid.

* * * * *